US012595989B2

(12) United States Patent
Austin, II et al.

(10) Patent No.: US 12,595,989 B2
(45) Date of Patent: Apr. 7, 2026

(54) MULTI-PART SHAPED CHARGE LINER

(71) Applicant: Schlumberger Technology Corporation, Sugar Land, TX (US)

(72) Inventors: David Austin, II, Rosharon, TX (US); John Fuller, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/442,552

(22) Filed: Feb. 15, 2024

(65) Prior Publication Data

US 2025/0264308 A1 Aug. 21, 2025

(51) Int. Cl.
*F42B 1/028* (2006.01)
*E21B 43/117* (2006.01)

(52) U.S. Cl.
CPC ..... *F42B 1/028* (2013.01); *E21B 43/117* (2013.01)

(58) Field of Classification Search
CPC ..... F42B 1/028; F42B 1/032; E21B 43/116; E21B 43/117
See application file for complete search history.

(56) References Cited

U.S. PATENT DOCUMENTS 2,837,995 A 6/1958 Castel
3,224,368 A 12/1965 House
3,732,818 A 5/1973 Thomanek
4,041,866 A 8/1977 Thevenin
4,487,130 A 12/1984 Brattström
4,498,367 A 2/1985 Skolnick
4,499,830 A * 2/1985 Majerus ..... F42B 1/032 102/307
4,798,145 A 1/1989 McVeagh
4,807,795 A 2/1989 LaRocca
5,175,391 A * 12/1992 Walters ..... F42B 1/036 102/307
5,251,530 A 10/1993 Kaeser
5,616,885 A 4/1997 Walters
6,021,714 A * 2/2000 Grove ..... F42B 1/032 102/307
6,840,178 B2 1/2005 Collins
(Continued)

FOREIGN PATENT DOCUMENTS

DE 2927556 C1 * 5/1985 ..... F42B 1/02
DE 19630339 A1 * 1/1997 ..... F42B 1/028
(Continued)

OTHER PUBLICATIONS

Kleiser, G. et al.; "Control of Shaped Charge Jets Through Nppon-uniform Confinement"; The 13th Hypervelocity Impact Symposium, Boulder Colorado, USA, Apr. 26-30, 2015; pp. 302-309.
(Continued)

*Primary Examiner* — Benjamin P Lee
(74) *Attorney, Agent, or Firm* — Jeffrey D. Frantz

(57) ABSTRACT

The present disclosure relates to a shaped charge liner. The shaped charge liner includes a first liner portion formed a first material. The first liner portion has an apex and a skirt section that define an interior volume of the first liner portion. The shaped charge liner also includes a second liner portion formed of a second material. The second liner portion is coupled to the first liner portion such that the second liner portion is an edge of the interior volume.

20 Claims, 9 Drawing Sheets

(56) References Cited

U.S. PATENT DOCUMENTS

| | | | | |
|---|---|---|---|---|
| 7,600,476 | B1 | 10/2009 | Baker | |
| 7,712,416 | B2 * | 5/2010 | Pratt | F42B 1/028 102/307 |
| 7,987,911 | B2 * | 8/2011 | Rhodes | F42B 1/028 175/4.6 |
| 9,612,094 | B1 | 4/2017 | Collier | |
| 10,520,286 | B2 * | 12/2019 | Loehken | F42B 1/028 |
| 11,053,782 | B2 * | 7/2021 | Loehken | E21B 43/119 |
| 11,215,039 | B2 | 1/2022 | Hinton | |
| 2005/0011395 | A1 | 1/2005 | Langan | |
| 2005/0115448 | A1 * | 6/2005 | Pratt | F42B 1/032 102/476 |
| 2007/0214991 | A1 | 9/2007 | Ronn et al. | |
| 2008/0047458 | A1 | 2/2008 | Storm | |
| 2008/0289529 | A1 * | 11/2008 | Schilling | F42B 1/032 102/307 |
| 2009/0050321 | A1 * | 2/2009 | Rhodes | F42B 1/032 102/476 |
| 2011/0155013 | A1 * | 6/2011 | Boyer | F42B 1/028 102/306 |
| 2011/0219978 | A1 * | 9/2011 | Glenn | F42B 1/028 102/307 |
| 2011/0239888 | A1 | 10/2011 | Waddell | |
| 2012/0247358 | A1 * | 10/2012 | Daoud | F42B 1/032 102/305 |
| 2013/0056208 | A1 * | 3/2013 | Xu | E21B 43/117 166/298 |
| 2013/0104765 | A1 * | 5/2013 | Stecher | F42B 1/032 102/476 |
| 2014/0076132 | A1 | 3/2014 | Bird | |
| 2014/0310940 | A1 | 10/2014 | Grattan | |
| 2015/0316360 | A1 | 11/2015 | Hinton | |
| 2016/0153267 | A1 | 6/2016 | Walker | |
| 2016/0209187 | A1 | 7/2016 | Stecher | |
| 2018/0030334 | A1 | 2/2018 | Collier | |
| 2023/0131652 | A1 | 4/2023 | Loehken | |

FOREIGN PATENT DOCUMENTS

| | | | | |
|---|---|---|---|---|
| GB | 2303687 A | * | 2/1997 | F42B 1/028 |
| GB | 2333825 A | * | 8/1999 | E21B 43/117 |
| RU | 2358094 C2 | | 6/2009 | |

OTHER PUBLICATIONS

Miller, S. et al., "The Role of Rayleigh Taylor Instability in Shaped Charge Jets Formation and Stability", 22nd International Symposium on Ballistics, Vancouver, BC, Canada, Nov. 14-18, 2005, 10 pages.

Tan, G. E. B. et al., "Planar Cutting Jets From Shaped Charges,", 22nd International Symposium on Ballistics, Vancouver BC, Canada, Nov. 14-18, 2005, 9 pages.

Walters, W. P. et al., "Fundamentals of Shaped Charges", CMC Press, Baltimore MD, 1989, pp. 1-10, 72-100, 171-265.

Office Action issued in U.S. Appl. No. 18/442,701 dated Apr. 18, 2025, 9 pages.

* cited by examiner

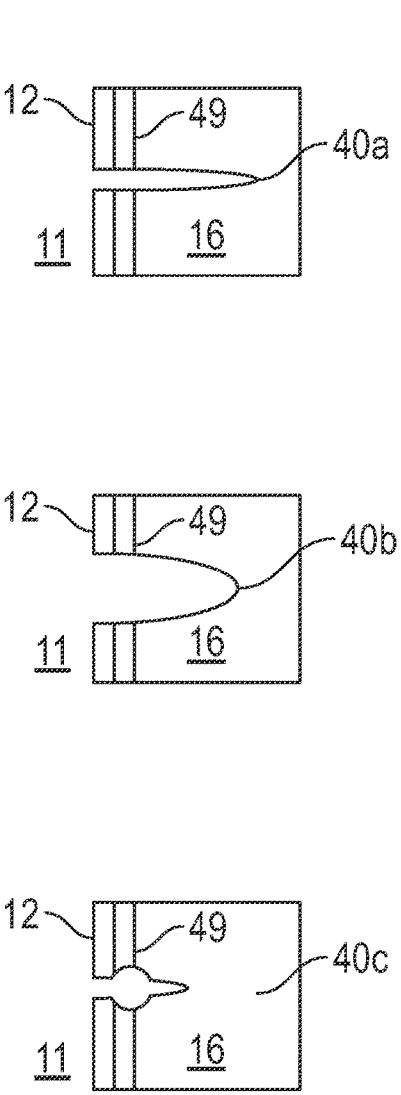
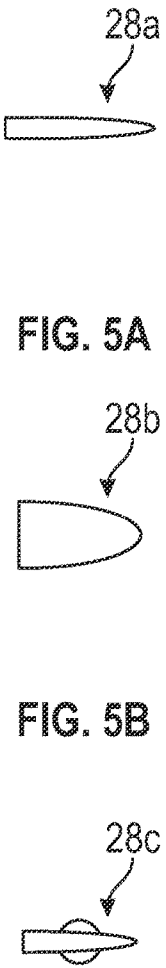
FIG. 5A
FIG. 5B
FIG. 5C
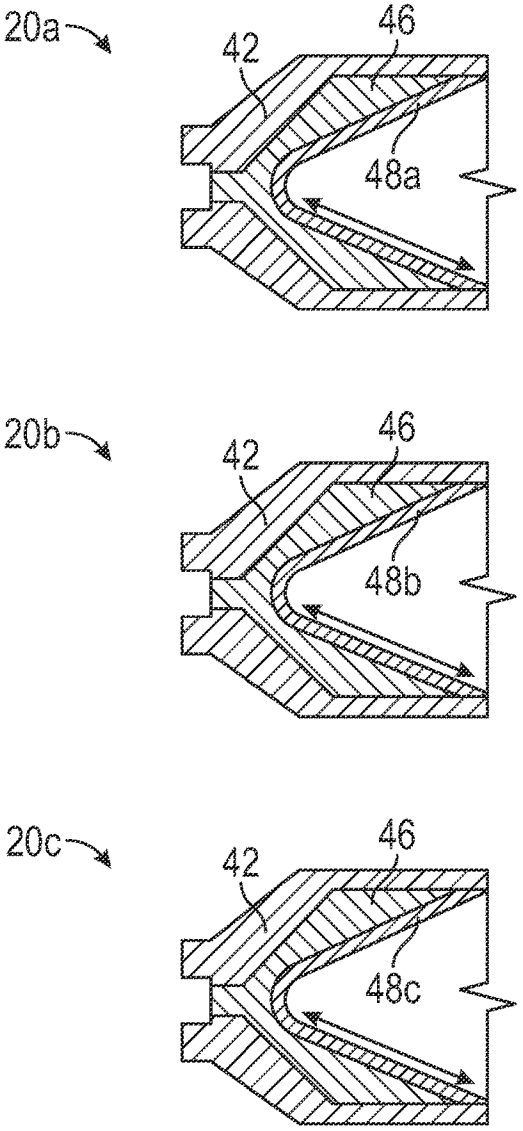

MULTI-PART SHAPED CHARGE LINER

BACKGROUND

The present disclosure generally relates to systems and methods for shaped charge liners having multiple parts.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admission of prior art.

Exploring, drilling, and completing hydrocarbon and other wells are generally complicated, time consuming and ultimately very expensive endeavors. As a result, over the years, well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbon reservoirs, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Indeed, a variety of isolating, perforating, and stimulating applications may be employed in conjunction with completions operations.

In the case of perforating, different zones of the well may be outfitted with packers and other hardware, in part for sake of zonal isolation. Thus, wireline or other conveyance may be directed to a given zone and a perforating gun employed to create perforation tunnels through the well casing. Specifically, shaped charges housed within a steel gun may be detonated to form perforations or tunnels into the surrounding formation, ultimately enhancing recovery therefrom.

The profile, depth, and other characteristics of the perforations are dependent upon a variety of factors in addition to the material structure through which each perforation penetrates. That is, the jet formed by the detonation of a given shaped charge may pierce a steel casing, cement, and a variety of different types of rock that make up the surrounding formation. However, characteristics of different components of the shaped charge itself may determine the characteristics of the jet, and ultimately the depth, profile, and overall effectiveness of each given perforation as described herein.

Among other components, a shaped charge generally includes a case, explosive pellet material, and a liner member. Thus, detonation of the explosive within the case may be utilized to direct the liner away from the gun and toward the well wall as a means by which to form the noted jet. Therefore, the characteristics of the jet are largely dependent upon the behavior of the liner and other shaped charge components upon detonation. For example, a solid copper or zinc liner may be utilized to generate a jet of considerable stretch with a head or tip that travels at 5-10 times the rate of speed as compared to the speed at the tail. Depending on the casing thickness, formation type, and other such well-dependent characteristics, this type of liner is generally of notable effectiveness in terms of achieving substantial depth of penetration.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, the present disclosure is directed to a shaped charge liner. The shaped charge liner includes a first liner portion formed of a first material. The first liner portion has an apex and a skirt section that define an interior volume of the first liner portion. The shaped charge liner also includes a second liner portion formed of a second material. The second liner portion is coupled to the first liner portion such that the second liner portion is an edge of the interior volume.

In one embodiment, the present disclosure is directed to a shaped charge. The shaped charge includes a casing member and an explosive component positioned within an interior volume of the casing. The shaped charge also includes a multi-material liner coupled to the explosive component. The multi-material liner includes a first liner portion and a second liner portion. The first liner portion is disposed between the explosive component and the second liner portion. The second liner portion is in contact with a surface of the first liner portion along an apex of the first liner portion.

In one embodiment, the present disclosure is directed to a method. The method includes forming a first shaped charge liner portion using a first material. The method also includes forming a second shaped charge liner portion using a second material. Further, the method includes coupling the second shaped charge liner portion to a surface of the first shaped charge liner portion.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 5A shows a diagram of the shaped charge of FIG. 4 forming a first type of jet, in accordance with aspects of the present disclosure;

FIG. 5B shows a diagram of the shaped charge of FIG. 4 forming a second type of jet, in accordance with aspects of the present disclosure;

FIG. 5C shows a diagram of the shaped charge of FIG. 4 forming a third type of jet, in accordance with aspects of the present disclosure;

DETAILED DESCRIPTION

Figure 1:
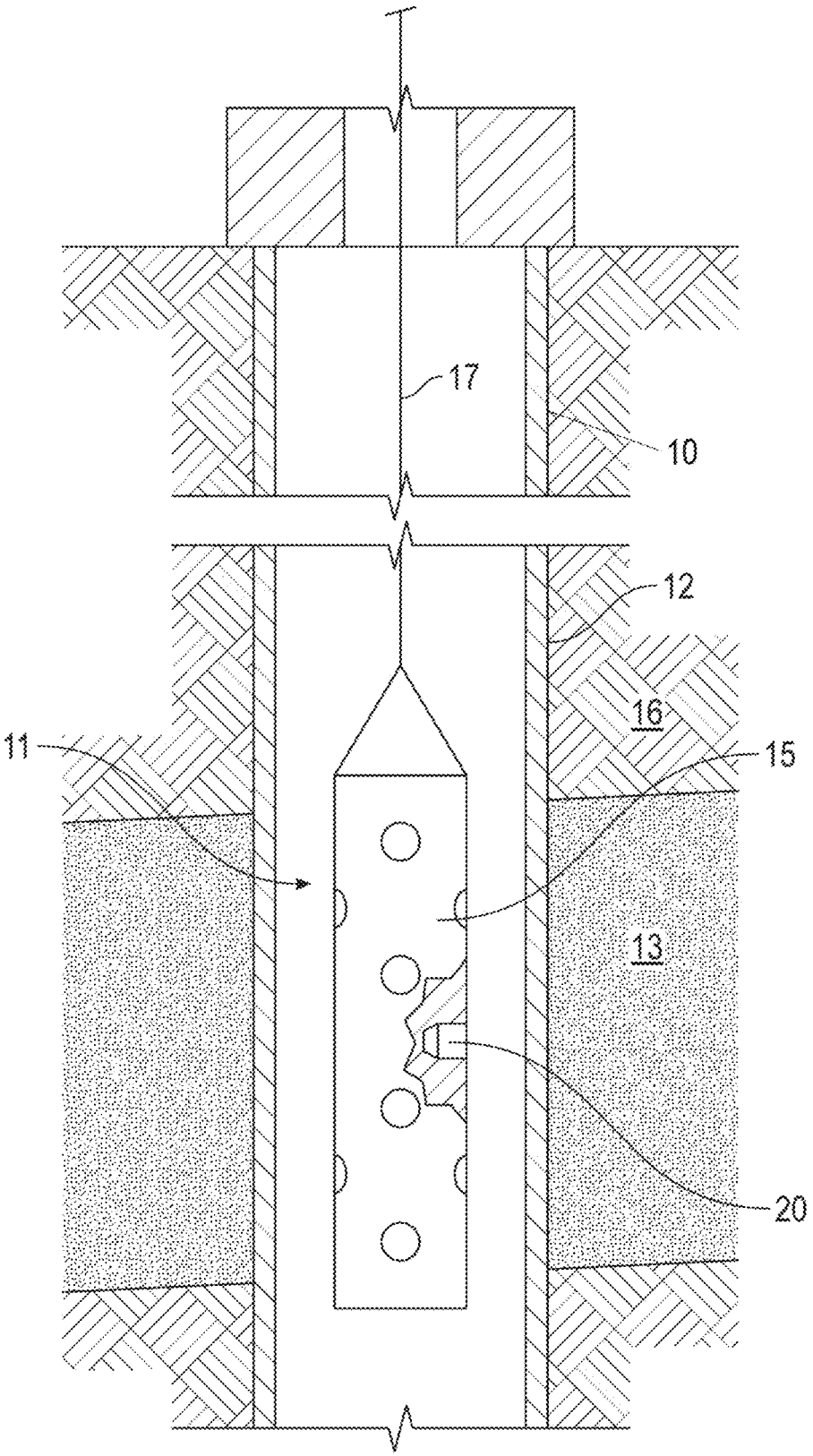
FIG. 1 shows a perforation operation, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As discussed above, shaped charges are used for a variety of oil and gas applications. In particular, the jet formed by the detonation of a given shaped charge may pierce a steel casing, cement, and a variety of different types of rock that make up the surrounding formation. The characteristics of the jet produced by a shaped charge are largely dependent upon the behavior of the liner and other shaped charge components upon detonation. At least in some instances, it may be advantageous to produce a jet from a material of a collapsing liner to puncture or sever certain areas in a wellbore, while not severing others. For example, it may be advantageous to sever a control line behind a completion prior to cementing as part of a plug and abandonment operation. To create such a jet, it may be advantageous to use relatively high density materials (e.g., metals) to form the liner in the shaped charge. However, there may be certain limitations in pressed liners or green compacts (e.g., pressed components) for shaped charges. As referred to herein, a "green compact" is a compact formed by pressurizing and cooling a powder to form a dense, solid mass, where the powders are held together by friction between the particles, as opposed to sintering the metal powders. As referred to herein, a "green density" refers to the density of a pressed compact. To improve techniques for green compact liners, it is advantageous to develop techniques to provide more density within the shaped charge.

Accordingly, the present disclosure relates to a multi-part shaped charge liner (e.g., multi-material shaped charge liner). In general, the multi-part shaped charge liner includes multiple liner parts or portions (e.g., a first liner portion and a second liner portion). In certain embodiments, the first liner portion may encapsulate the second liner portion. For example, the first liner portion may include an apex and a skirt section that define an interior volume of the first liner portion. In such an embodiment, the second liner portion is disposed within the first liner portion such that the second liner portion at least partially surrounds the interior volume. For example, the second liner portion may be in contact with an outer surface of the apex, an outer surface of the skirt section, or both. However, in certain embodiments, the second liner portion may be disposed on an exterior of the first liner portion and, thus, be coupled to the apex of the first liner portion. In some instances, the second liner portion may be formed of a denser material. In any case, upon detonation of the explosive component, the first liner portion and the second liner portion collapse to form a denser material that provides more momentum to the resulting jet as compared to green, pressed liners formed from conventional techniques.

With reference to FIG. 1, after a well 10 is drilled, a casing 12 is typically run in the well 10 and cemented to the well 10 in order to maintain well integrity. After the casing 12 has been cemented in the well 10, one or more sections of the casing 12 that are adjacent to the formation zones of interest (e.g., target well zone 13) may be perforated to allow fluid from the formation zones to flow into the well for production to the surface or to allow injection fluids to be applied into the formation zones. To perforate a casing section, a perforating gun string may be lowered into the well 10 to a desired depth (e.g., at target zone 13), and one or more perforation guns 15 may be fired to create openings in the casing 12 and to extend perforations into the surrounding formation 16. Production fluids in the perforated formation 16 can then flow through the perforations and the casing openings into the wellbore 11.

Typically, perforating guns 15 (which include gun carriers and shaped charges mounted on or in the gun carriers or, alternatively, include sealed capsule charges) are lowered through tubing or other pipes to the desired formation interval on a line 17 (e.g., wireline, e-line, slickline, coiled tubing, and so forth). The charges carried in a perforating gun 15 may be phased to fire in multiple directions around the circumference of the wellbore 11. Alternatively, the charges may be aligned in a straight line. When fired, the charges create perforating jets that form holes in the surrounding casing 12 as well as extend perforation tunnels into the surrounding formation 16.

With reference to FIG. 1, certain embodiments of the present disclosure include a perforation system comprising: (1) a perforating gun 15 (or gun string), wherein each gun may be a carrier gun (as shown) or a capsule gun (not shown); and (2) one or more improved shaped charges 20 loaded into the perforating gun 15 (or into each gun of the gun string), each charge having a liner member, as described herein; and (3) a conveyance mechanism 17 for deploying the perforating gun 15 (or gun string) into a wellbore 11 to align at least one of said shaped charges 20 within a target formation interval 13, wherein the conveyance mechanism may be a wireline, tubing, or other conventional perforating deployment structure; among other components.

Examples of explosives (e.g., explosive component as described in FIG. 4) that may be used in the various explosive components (e.g., charges, detonating cord, and boosters) include RDX (cyclotrimethylenetrinitramine or hexahydro-1,3,5-trinitro-1,3,5-triazine), HMX (cyclotetramethylenetetranitramine or 1,3,5,7-tetranitro-1,3,5,7-tetraazacyclooctane), TATB (triaminotrinitrobenzene), HNS (hexanitrostilbene), and others.

Figure 2:
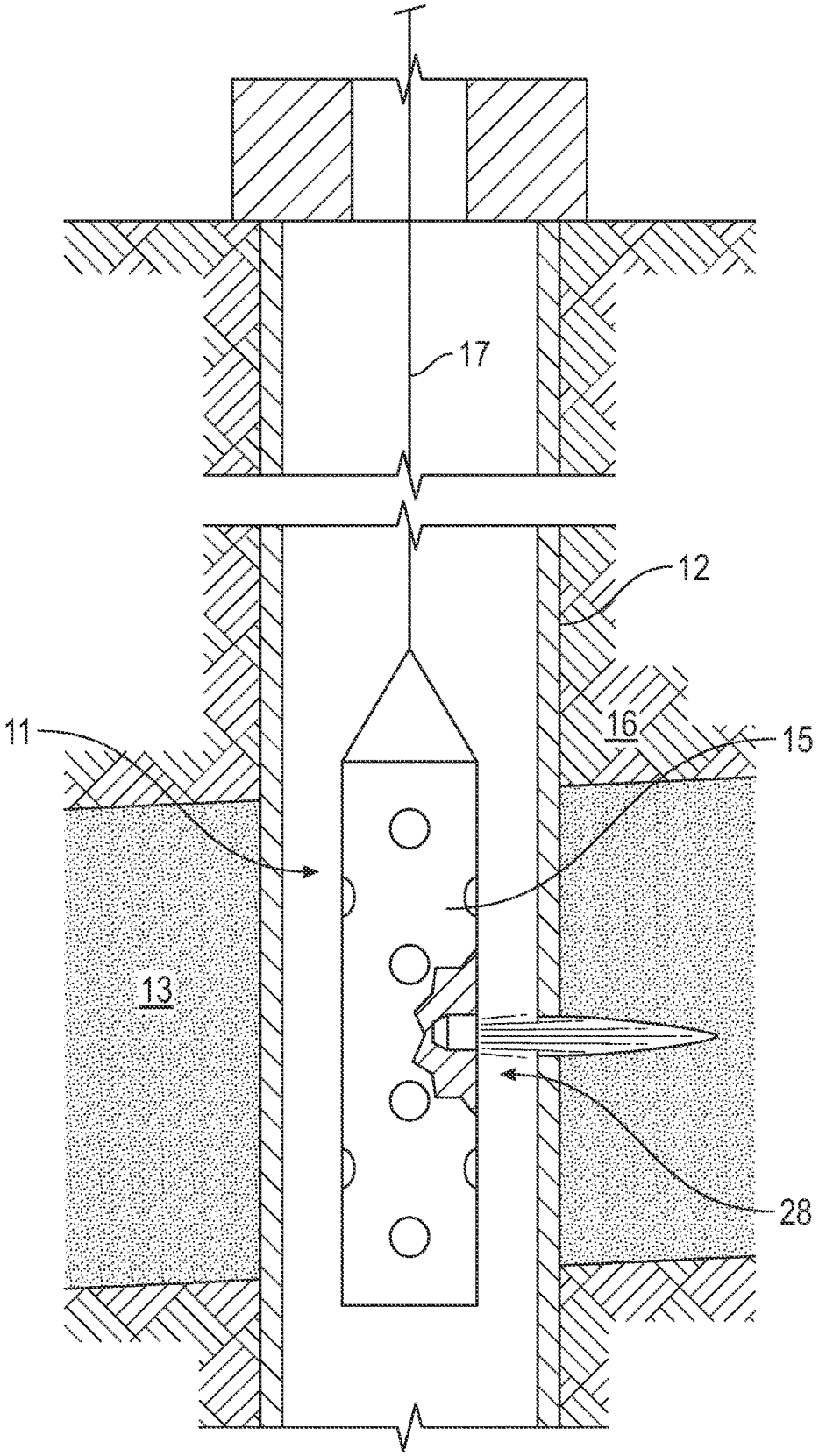
FIG. 2 shows a diagram illustrating a perforation being made with a perforation gun, in accordance with aspects of the present disclosure.
Figure 3:
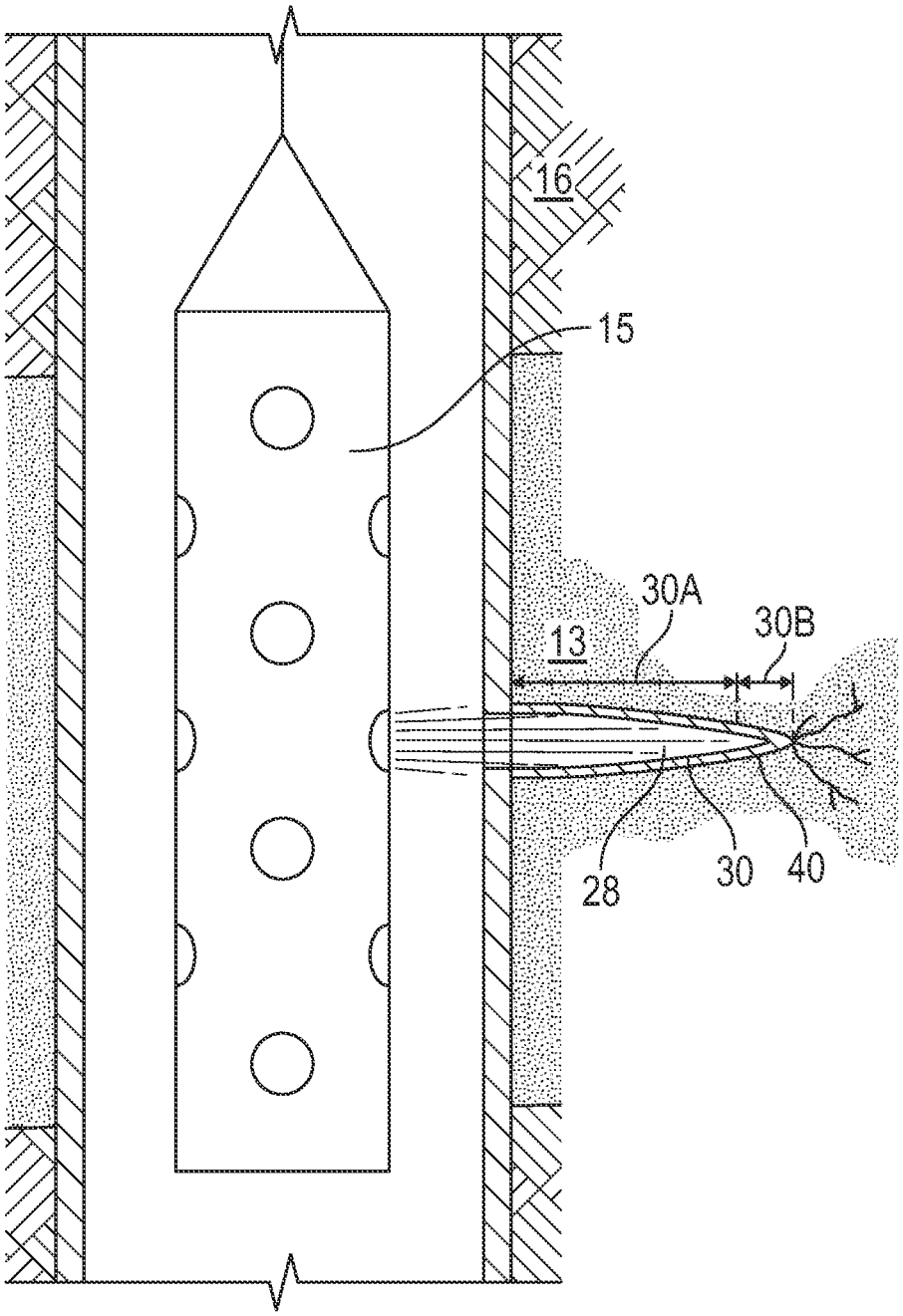
FIG. 3 shows a diagram illustrating a perforation and a tunnel made with a shaped charge, in accordance with aspects of the present disclosure.

Referring to FIGS. 2 and 3, the material from a collapsed liner of the shaped charge 20 (e.g., as described in more detail in FIG. 4) forms a perforating jet 28 that shoots through the front of the shaped charge and penetrates the casing 12 and underlying formation 16 to form a perforated tunnel (or perforation tunnel) 40. Around the surface region adjacent to the perforated tunnel 40, a layer of residue 30 from the charge liner is deposited. The charge liner residue 30 includes "wall" residue 30A deposited on the wall of the perforating tunnel 40 and "tip" residue 30B deposited at the tip of the perforating tunnel 40. As described in more detail with respect to FIG. 5, adjusting properties of the shaped charge 20 (e.g., the geometry of the liner, the density of the liner, the mechanical strength of the liner, and so on) may adjust jet properties (e.g., jet velocity and/or jet shape) of the perforating jet 28.

Figure 4:
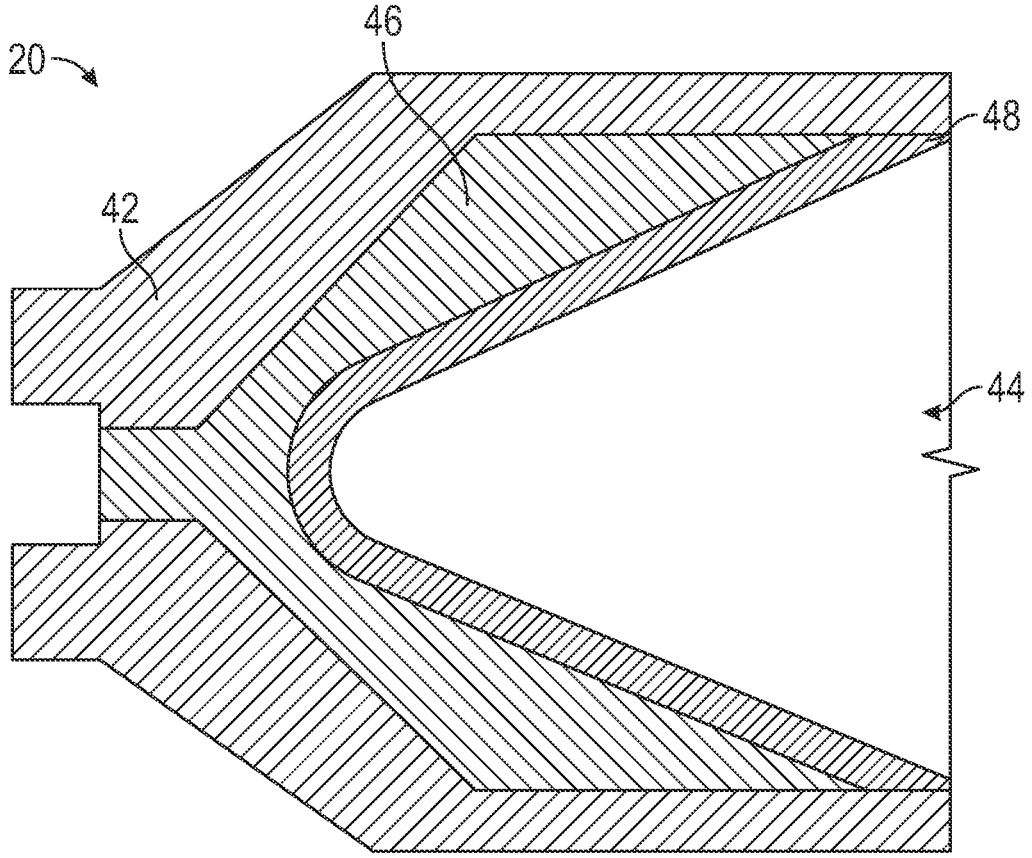
FIG. 4 shows a cross-sectional view of an embodiment of a shaped charge, in accordance with aspects of the present disclosure.

Referring now to FIG. 4, a cross sectional view of an embodiment of a shaped charge 20 is shown. The shaped charge 20 includes a casing member 42 and an interior volume 44 that is defined by an explosive component 46 and a liner member 48. The explosive component 46 is disposed between the casing member 42 and the liner member 48 such that the liner member 48 surrounds the interior volume 44.

The liner member 48 may be formed of packed, powdered metals and, in at least some instances, non-metallic materials. The metals of the liner member 48 may include metals having a density of approximately 6 or greater grams per cubic centimeter (g/cc), 7 or greater g/cc, 8 or greater g/cc, 9 or greater g/cc, 10 or greater g/cc, 11 or greater g/cc, 12 or greater g/cc, or 13 or greater g/cc, and so on. In some embodiments, the metals of the liner member 48 may include metals having a density less than approximately 6 g/cc (e.g., aluminum, beryllium, titanium, and so on). For example, the liner member 48 may include copper (e.g., having a density of approximately 8.9 g/cc) and/or lead (e.g., having a density of approximately 11.3 g/cc). In some embodiments, the liner member 48 may include tungsten (e.g., having a density of approximately 19.3 g/cc). In some embodiments, the liner member 48 may include a mixture of metals, which may provide a desired density. For example, the liner member 48 may include approximately 50 weight percent (wt %) or greater, approximately 60 wt % or greater, approximately 70 wt % or greater, approximately 80 wt % or greater, or approximately 90 wt % or greater of a first metal (e.g., tungsten). Further, the liner member 48 may include a remaining wt % of a second metal (e.g., copper or lead), such as approximately 10 wt % or less, 20 wt % or less, 30 wt % or less, and so on.

As mentioned above, the liner member 48 may also include non-metallic materials, such as nitrides, carbides, oxides, diamond, ceramic materials, or a combination thereof. For example, the liner member 48 may include relatively low density materials (e.g., as compared to the metals), such as SiC, $Si_3N_4$, $SiO_2$, $B_4C$, $B_4N$, ZnO, TiC, $Li_3N$, $TiO_2$, $Mg_3N_2$, and other relatively low density non-metallic materials. In some embodiments, the liner member 48 may include a polymer material, such as fluorinated polymers (e.g., polytetrafluoroethylene). In some embodiments, the liner member 48 may include metal-polymer composite mixtures. In such embodiments, the liner member 48 may include a first weight percent (wt %) (e.g., first amount) of one or more metals and a second wt % of one or more non-metallic materials. For example, the liner member 48 may include approximately 50 wt % or greater, 60 wt % or greater, 70 wt % or greater, 80 wt % or greater, 90 wt % or greater of one or more metals. As such, the liner member 48 may include approximately 50 wt % or less, 40 wt % or less, 30 wt % or less, 20 wt % or less, or 10 wt % or less of one or more non-metallic materials.

Referring specifically now to FIGS. 5A, 5B, and 5C (e.g., collectively FIGS. 5A-5C), side cross-sectional views of different types of shaped charges 20*a*, 20*b*, and 20*c* in use during perforating applications are shown. That is, in each case, a charge 20*a*, 20*b*, and 20*c* has been loaded into a perforating gun (not shown), and utilized in a perforating application in a well 10. The charges 20*a*, 20*b*, and 20*c* may be made up of generally the same features described with respect to FIG. 1. For example, the charges 20*a*, 20*b*, and 20*c* may include the same type of casing 12 and explosive component 46. However, in each case, a different type of liner member 48*a*, 48*b*, and 48*c* may be used to provide a different type of charge 20*a*, 20*b*, and 20*c* for a different type of perforating application.

With reference to FIG. 5A in particular, a deep penetrating jet shaped charge 20*a* is shown. Upon detonation, a deep penetrating jet 28*a* is formed and directed at the casing 12 that defines the well 10. Ultimately, this forms a perforation tunnel 40*a* that penetrates through the casing member 42, cement 49, and into the adjacent formation 16 so as to aid in hydrocarbon recovery therefrom. In the embodiment shown, the liner 48*a* that is used to form the jet 28*a* and achieve such penetration may be a comparatively thin but high-density tungsten-based liner member 48*a* so as to form a thinner and longer jet 28*a*. The end result, depending largely on the particular characteristics of the casing 12, may be a perforation tunnel 40*a* of between approximately 30 and approximately 40 inches deep with a diameter of between approximately 0.3 inches and approximately 0.4 inches.

Of course, as depicted in the embodiment of FIG. 5B, a different type of liner 48*b* may be utilized to obtain a different type of charge 20*b* and performance during perforation. More specifically, in the embodiment of FIG. 5B, a side cross-sectional view of wide jet shaped charge 20*b* is shown. In this case, the liner member 48*b* is of a comparatively thicker dimensions and lower density, perhaps with a lower percentage of tungsten. Thus, a comparatively thicker or wider jet 28*b* may be formed. The end result, again depending on characteristics of the casing 12 and other physical factors, may be a shorter perforation tunnel 40*b* that is closer to a threshold distance (e.g., 60-90 cm deep but with a wider diameter (e.g. between about 1 cm and about 1.3 cm).

Referring now to FIG. 5C, a side cross-sectional view of a combination jet shaped charge 20*c* is shown. In this case, the liner member 48*c* may be of a thickness, density, materials and other characteristics similar to either of the deep penetrating 48*a* or wide 48*b* liner member types described above. However, the combination liner member 48*c* of FIG. 5C is of a uniquely tailored non-uniform morphology. Thus, a combination jet 28*c* may ultimately be formed such that the perforation tunnel 40*c* which is formed is also of a uniquely tailored morphology.

Accordingly, FIGS. 5A-5C show that altering physical properties (e.g., density) of the liner member 48 adjusts the shape of the resulting jet 28. That is, by altering the explosive component 46, the liner 48, and/or mass distributions of an axisymmetric shaped charge design, the charge may be converted to an alternate symmetry. It is presently recognized that for cutting control lines, it may be advantageous to use a shaped charge having a planar symmetry, whereby mass is added or removed at pole 180 degrees apart. As a result, during jet collapse, the normally axially uniform fast-moving jet is converted to a slower fan-like geometry that cuts the line spanning multiple degrees from the axis of symmetry serves to provide increase coverage of the cutter while still achieving velocities and densities inside the cutting fan, which are comparable to linear slot cutters, but which can utilize existing hardware and manufacturing methods.

Figure 6:
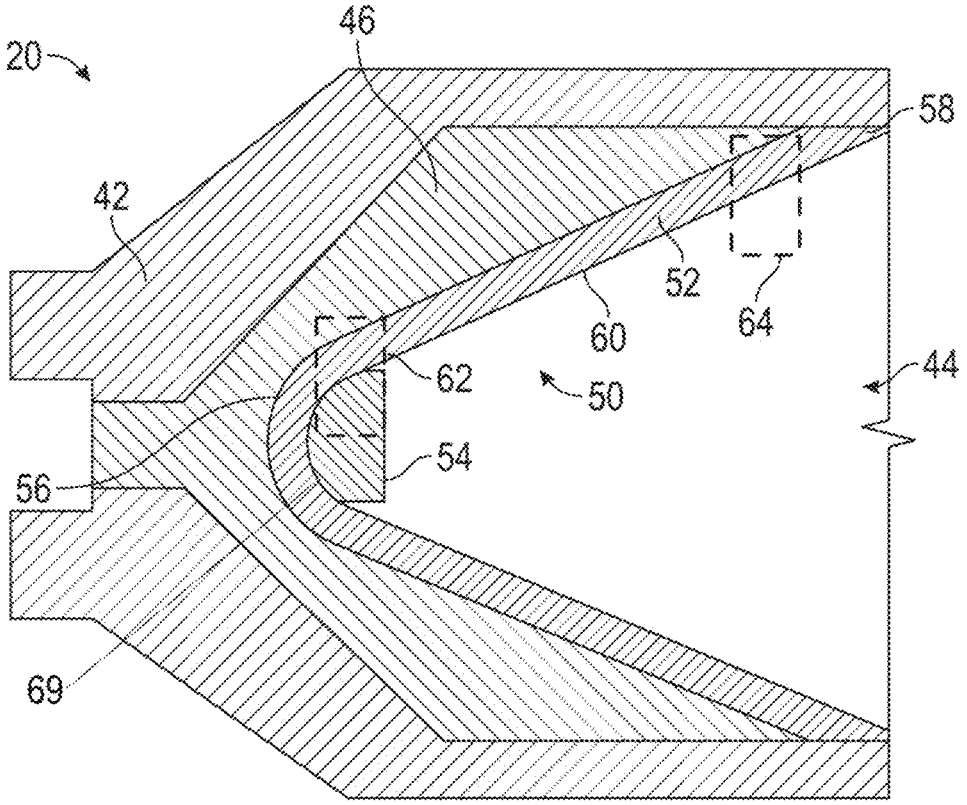
FIG. 6 shows a cross-sectional view of an embodiment of a shaped charge that includes a first example of a multi-part shaped charge liner, in accordance with aspects of the present disclosure.

As described herein, it is presently recognized that it may be advantageous to form a liner member 48 that includes two or more metals (e.g., metal powders) or metal powder mixtures to provide a density in a location within the interior volume 44, as discussed below, in an advantageous location to provide a desired geometry of the jet. In some embodiments, the liner 48 may have high average green density and low average density after pressing. FIG. 6 shows a cross-sectional view of a shaped charge 20 having a multi-part shaped charge liner 50 in accordance with the present disclosure. In general, the multi-part shaped charge liner 50 includes multiple layers, multiple parts, or multiple portions formed of different materials that are green compacts, which provide more green density to improve the momentum of the jet formed from detonation.

As shown in FIG. 6, the multi-part shaped charge liner 50 includes a first liner portion 52 and a second liner portion 54. As illustrated, the first liner portion 52 includes a generally conical shape having an apex 56 and a skirt section 58 (e.g., that gradually extends radially outward from the apex 56 to an axial end of the skirt section 58, for example, relative to an axis 72). The apex 56 and the skirt section 58 generally define the interior volume 44 (e.g., inner volume) of the multi-part shaped charge liner 50 as described herein. The first liner portion 52 contacts an inner surface (not shown) of the second liner portion 54.

In some embodiments, the first liner portion 52 includes a mixture of metals and non-metallic materials. For example, the first liner portion 52 may be a green compact formed of a powder including one or more metals and one or more non-metallic materials. Additionally or alternatively, the second liner portion 54 may include a mixture of metals and non-metallic materials. In some embodiments, the first liner portion 52 may be formed of relatively denser materials than the second liner portion 54. In some embodiments, the first liner portion 52 may be formed using machined metal parts, injected molded plastic parts, ceramic parts, metallic or non-metallic powders, or a combination thereof. However, in some embodiments, the first liner portion 52 and the second liner portion 54 may be formed of the same material.

As illustrated, the second liner portion 54 is in contact with the outer surface 60 (e.g., outer liner surface) (e.g., relative to the shaped charge 20) of the first liner portion 52. In particular, the second liner portion 54 contacts the outer surface 60 along the apex 56 of the first liner portion 52. However, at least in some instances, the second liner portion 54 may contact the outer surface 60 that generally runs along the skirt section 58, as described in more detail with respect to FIG. 7. In any case, the first liner portion 52 is disposed between the second liner portion 54 and the explosive component 46 such that the second liner portion 54 contacts or is otherwise a surface that is along an edge of the interior volume 44 of the shaped charge 20. As discussed above, upon detonation of the explosive component 46, the second liner portion collapses inward to form a perforating jet 28.

In the illustrated embodiment, the second liner portion 54 is disposed within, or otherwise contacts, the apex 56 of the first liner portion 52. As such, the multi-part shaped charge liner 50 includes a relatively larger volume of material (e.g., metal powder and, in some instances, non-metallic material) at the apex 56 as compared to the skirt portion 58. By providing the second liner portion 54 at the apex 56, the multi-part shaped charge liner 50 may include different amounts of material at different portions of the multi-part shaped charge liner 50. For example, the multi-part shaped charge liner 50 includes a first volume portion 62 that includes the first liner portion 52 and the second liner portion 54. Further, the multi-part shaped charge liner 50 may include a second volume portion 64 that includes the first liner portion 52 and not the second liner portion 54. Accordingly, the multi-part shaped charge liner 50 has a relatively higher density within the first volume portion 62 as compared to the second volume portion 64. As discussed herein, it is presently recognized that increasing the density of certain portions of the multi-part shaped charge liner 50 may enable tuning of the shape of the resulting perforating jet 28.

Figure 7:
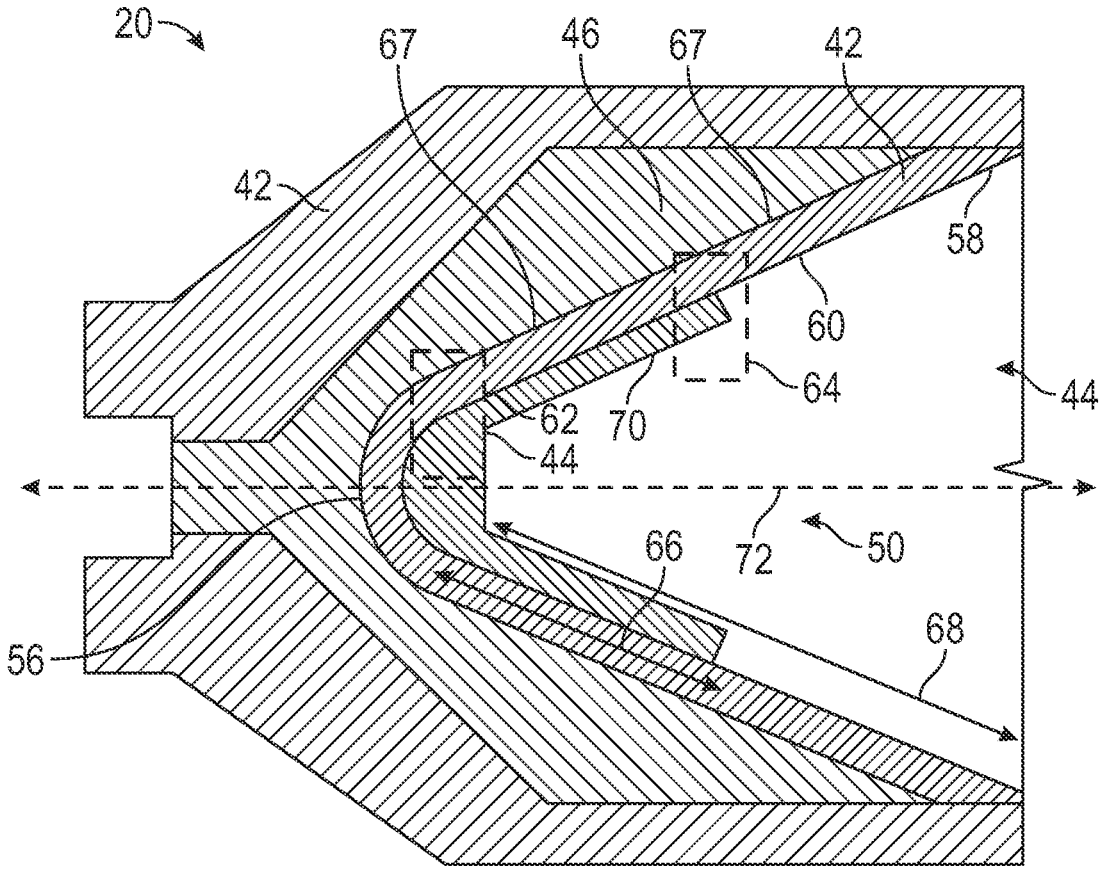
FIG. 7 shows a cross-sectional view of an embodiment of a shaped charge that includes a second example of a multi-part shaped charge liner, in accordance with aspects of the present disclosure.

As another example, FIG. 7 shows a cross-sectional view of multi-part shaped charge liner 50. In generally similar manner as described above with respect to FIG. 6, the multi-part shaped charge liner 50 includes a first liner portion 52 having an apex 56 and a skirt section 58. The apex 56 and the skirt section 58 generally define the interior volume 44 as described herein. Further, the multi-part shaped charge liner 50 includes a second liner portion 54. The first liner portion 52 is disposed between the second liner portion 54 and the explosive component 46 such that the second liner portion 54 at least partially covers the outer surface 60 along the skirt section 58.

In the illustrated embodiment, the second liner portion 54 is disposed within, or otherwise contacts, the apex 56 of the first liner portion 52. Further, the second liner portion 54 at least partially extends along the skirt section 58 of the first liner portion 52. As such, the multi-part shaped charge liner 50 includes a varying amount of material along the walls that define the interior volume 44. For example, the multi-part shaped charge liner 50 may include a first volume of material (e.g., metal powder and, in some instances, non-metallic material) within at the apex 56, a second volume of material at a first location along the skirt section 58, and a third volume of material at a second location along the skirt section 58.

As shown, the second liner portion 54 extends along a length portion 66 of the skirt section 58. While the illustrated embodiment shows the second liner portion 54 extending along approximately half the skirt section 58, it should be noted that the second liner portion may extend along any suitable portion of the skirt section 58, such as 10% or less of the total length 68 of the skirt section 58, 20% or less of the total length 68 of the skirt section 58, 30% or less of the total length 68 of the skirt section 58, 40% or less of the total length 68 of the skirt section 58, 50% or less of the total length 68 of the skirt section 58. In some embodiments, the second liner portion 54 may extend along a majority of the skirt section 58 (e.g., greater than 50% of the total length 68 of the skirt section 58). For example, the second liner portion 54 may extend along 50% or greater of the total length 68 of the skirt section 58, 60% or greater of the total length 68 of the skirt section 58, 70% or greater of the total length 68 of the skirt section 58, 80% or greater of the total length 68 of the skirt section 58, 90% or greater of the total length 68 of the skirt section 58.

Further, it should be understood that as FIG. 7 illustrates a cross-sectional view of the shaped charge 20, the second liner portion 54 that extends along the length portion 66 of the skirt section 58 may be axially symmetric about the axis 72. That is, the second liner portion 54 may be axially symmetric. However, in some embodiments, the second liner portion 54 and/or the first liner portion 52 may include regions that are planar symmetric, doubly planar symmetric, or other types of symmetries. It should be noted that tuning the symmetry of the multi-part shaped charge liner 50 may tune the shape and/or velocity of the resulting perforating jet 28.

As noted above, the second liner portion 54 may be disposed on an exterior of the first liner portion 52 and, thus, be coupled to the apex of the first liner portion 52. For example, the second liner portion 54 may be physically coupled to an outer first liner surface 60 of the first liner portion 52. The outer first liner surface 60 generally includes or extends along the apex 56 as compared to the second liner portion partially surrounding the outer surface 60 as illustrated. In any case, the density within the volume of the shaped charge 20 that includes the first volume portion that includes the first liner portion 52. Further, the multi-part shaped charge liner 50 includes the second volume portion 64 that includes the first liner portion 52 and the second liner portion 54, however, the second volume portion 64 includes relatively less of the second liner portion 54 than the first volume portion 62. Accordingly, the multi-part shaped charge liner 50 has a relatively higher density within the first volume portion 62 as compared to the second volume portion 64.

As shown, the thickness 70 of the second liner portion 54 along the length portion 66 is relatively even. However, in some embodiments, the thickness 70 of the second liner portion 54 along the length portion 66 and/or near the apex 56 may be variable. For example, the thickness 70 along the length portion 66 may vary in a periodic manner (e.g., increasing and decreasing), increase (e.g., linearly or exponentially), or decrease (e.g., linearly or exponentially), and so on. As another non-limiting example, the thickness 70 of the second liner portion 54 may be greater at the apex 56 while less thick along the skirt section 58. Alternatively, the thickness 70 of the second liner portion 54 may be less at the apex 56 while thicker along the skirt section 58. For example, the thickness 70 may vary at different axis positions along the axis 72.

As shown, the thickness 70 of the second liner portion 54 is relatively constant. In some embodiments, the thickness 70 of the second liner portion 54 may decrease outwards towards the first liner portion 52 such that the second liner portion 54 may blend with the first liner portion 54. In this way, the second liner portion 54 may terminate parallel to a plane that is normal to the direction of the jet (e.g., along axis 72). For example, 15% or less, 10% or less, 5% or less, 4% or less, 3% or less, 2% or less, or 1% or less of the thickness 70 of the second liner portion 54 along the length 66 may decrease (e.g., linearly, or non-linearly) and, ultimately, terminate on a plane normal to the axis 72.

Figure 8:
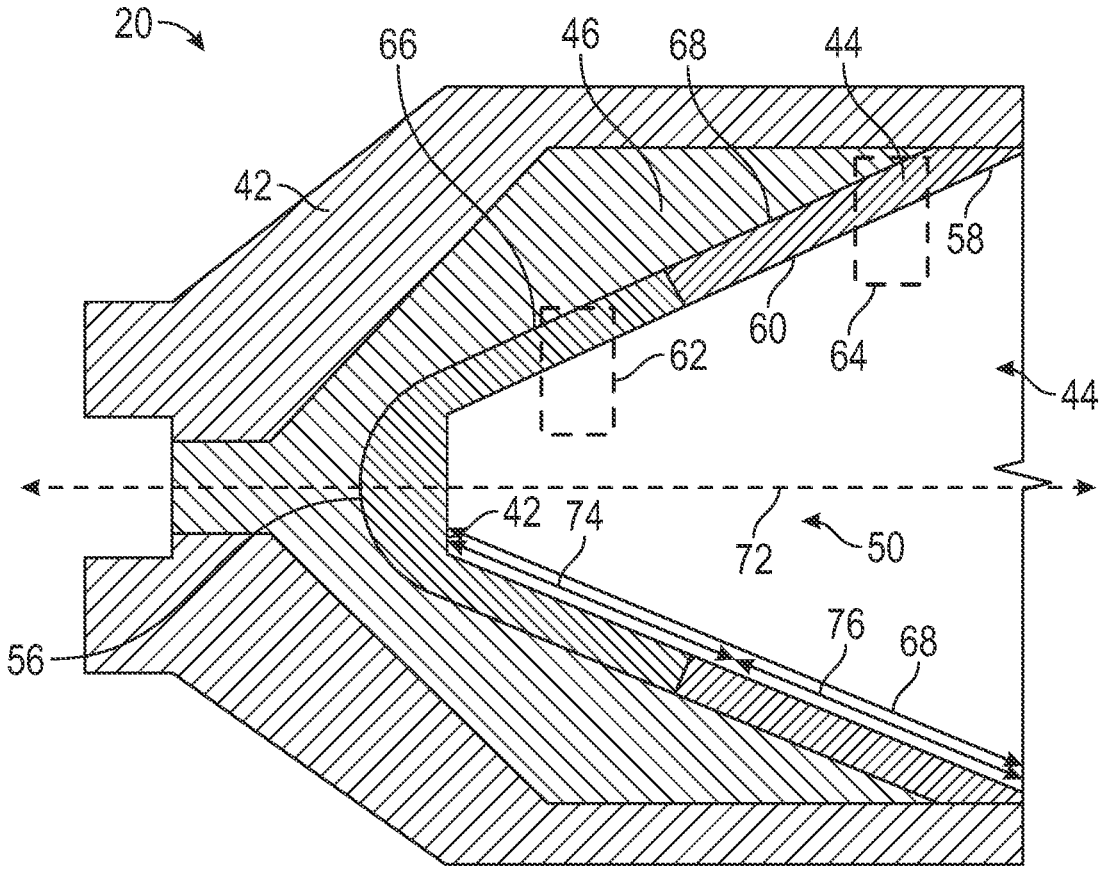
FIG. 8 shows a cross-sectional view of an embodiment of a shaped charge that includes a third example of a multi-part shaped charge liner, in accordance with aspects of the present disclosure.

In some embodiments, the first liner portion 52 and the second liner portion 54 of the multi-part shaped charge liner 50 may be formed along different axial positions about the axis 72. To illustrate this, FIG. 8 illustrates a cross-sectional view of a third example of the multi-part shaped charge liner 50 in accordance with the present disclosure. In a generally similar manner as described with respect to FIGS. 6 and 7, the multi-part shaped charge liner 50 includes the first liner portion 52 and the second liner portion 54. As shown, the first liner portion 52 includes a generally conical shape having an apex 56 and a skirt section 58. However, the first liner portion 52 may have any suitable shape or symmetry as described herein.

As shown in the illustrated embodiment, the first liner portion 52 is physically coupled to a first outer surface 67 of the explosive component 46. Further, the second liner portion 54 is also physically coupled to a second outer surface 69 of the explosive component 46. Accordingly, both the first liner portion 52 and the second liner portion 54 form the skirt section 58 of the multi-part shaped charge liner 50. As shown, the first liner portion 52 extends along a first inner surface portion 74 of the total length 68 of the skirt section 58. The second liner portion 54 extends along a second inner surface portion 76 of the total length 68 of the skirt section 58. In such embodiments, the first liner portion 52 and the second liner portion 54 may not substantially overlap. Instead, the first liner portion 52 may abut the second liner portion 54.

As described herein, the first liner portion 52 may be formed of a different material than the second liner portion 54. Accordingly, in embodiments where the first liner portion 52 is formed of a denser material than the second liner portion 54, the first volume portion 62 has a relatively higher density as compared to the second volume portion 64.

Figure 9:
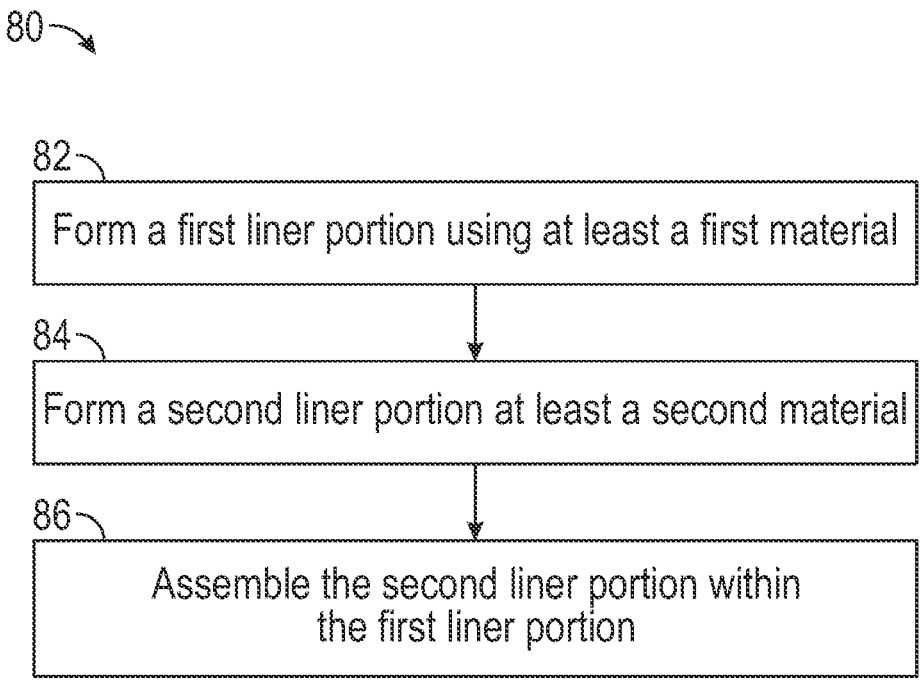
FIG. 9 shows a flow diagram of a method for assembling a multi-part shaped charge liner, in accordance with aspects of the present disclosure.

In any case, as described herein, the disclosed techniques for forming the multi-part shaped charge liner 50 may provide a liner that forms a relatively denser green material and, thus, provide more momentum for the jet formed by detonation. FIG. 9 shows an example process 80 for forming the multi-part shaped charge liner 50 in accordance with the present disclosure. As shown, the process 80 includes, at block 82, forming the first liner portion 52 using at least a first material. In general, the first liner portion 52 may be formed by press forming the material. At block 84, the process 80 includes forming a second liner portion 54 using at least a second material. Then, at block 86, the process 80 includes assembling the second liner portion 54 and the first liner portion 52, thereby forming the multi-part shaped charge liner 50.

In some embodiments, assembling the second liner portion 54 and the first liner portion 52 may include providing the second liner portion 54 onto the outer first liner surface 60 of the first liner portion 52. For example, the second liner portion 54 may be provided to the apex 56 of the first liner portion 52. As another non-limiting example, the second liner portion 54 may be provided along the skirt of the first liner portion 52. As such, the second liner portion 54 may extend along at least a portion of the skirt section 58 (e.g., only a portion or the entire skirt section 58). As another non-limiting example, the second liner portion 54 may be provided along both the skirt section 58 and the apex 56.

In some embodiments, assembling the second liner portion 54 and the first liner portion 52 may include providing the first liner portion 52 onto the first outer surface 67 of the explosive component 46. Alternatively, assembling the second liner portion 54 and the first liner portion 52 may include providing the first liner portion 52 onto the first outer surface 67 of the second liner portion 54.

At least in some instances, one or more of the blocks 82, 84, and 86 of the process 80 may be omitted or combined. For example, in some embodiments, the second liner portion 54 may be formed using the first liner portion 52 such that effectively no separate assembly step may be performed. For example, the first liner portion 52 may be used as a form, die, molding, or tooling to form the second liner portion 54. As such, the second liner portion 54 may be provided as an adjoined composite liner to the first liner portion 52, based on the existing shape of the first liner portion 52. In this way, the process 80 may generally include blocks 82 and 84, while block 86 is omitted since the second liner portion 54 is formed using the first liner portion 52 as a form, die, mold, or tooling.

Accordingly, the present disclosure relates to a multi-part shaped charge liner 50. In general, the multi-part shaped charge liner 50 includes two or more material powders or metal powder mixtures that may have a variable average green density after pressing. The multi-material shaped charge liner 50 may include different types of symmetries (e.g., axial symmetry (e.g., symmetry about the axis 72), planar symmetric (e.g., symmetric about a plane perpendicular to the axis 72), doubly planar symmetry (e.g., having multiple regions that are symmetric about a respective plane that is perpendicular to the axis 72)) that provide a different shaped jet. For example, a planar symmetric mass distribution may provide a fan-line cutting jet upon detonation. In any case, the multi-part shaped charge liner 50 may be composed of materials other than powders, such as machine metal parts, injection molded plastic parts, ceramic parts, or a combination thereof. Further, the multi-part shaped charge liner 50 could be axisymmetric in geometry or have additional volume at the apex, skirt, or other region(s) which are planar symmetric, doubly planar symmetric, or symmetric on another period. For example, the multi-part shaped charge liner 50 may include a vary thickness that intrudes into the region either towards or away from the central axis.

While only certain features of the invention have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A shaped charge liner, comprising:

a first liner portion formed of a first metallic material and a first non-metallic material, wherein the first liner portion comprises a first apex and a first skirt section that define an interior volume of the first liner portion, wherein a first inner surface of the first liner portion is configured to couple to an explosive component of a shaped charge, and wherein an outer surface of the first liner portion comprises a curved surface along the first apex; and a second liner portion formed of a second metallic material and a second non-metallic material, wherein a second inner surface of the second liner portion is coupled to the first liner portion such that the second liner portion is an edge of the interior volume, wherein the second liner portion comprises a second apex and a second skirt section, and wherein the second liner portion comprises a flat planar surface along the second apex;

wherein the first liner portion lacks a first binder to hold the first metallic material and the first non-metallic material together, and the second liner portion lacks a second binder to hold the second metallic material and the second non-metallic material together.

2. The shaped charge liner of claim 1, wherein the first liner portion has a first green density and the second liner portion has a second green density that is different than the first green density.

3. The shaped charge liner of claim 1, wherein the second liner portion is disposed adjacent the first apex of the first liner portion and extends along a portion of the first skirt section of the first liner portion.

4. The shaped charge liner of claim 1, wherein the first metallic material is different than the second metallic material, the first non-metallic material is different than the second non-metallic material, or both.

5. The shaped charge liner of claim 1, wherein the shaped charge liner is a pressed component.

6. The shaped charge liner of claim 1, wherein the second liner portion is axially symmetric.

7. The shaped charge liner of claim 1, wherein the first liner portion, the second liner portion, or both, comprise machine metal parts, injection molded plastic parts, ceramic parts, or any combination thereof.

8. The shaped charge liner of claim 1, wherein the first skirt section, the second skirt section, or both, comprise one or more regions having planar symmetry.

9. The shaped charge liner of claim 1, wherein a density of the second liner portion is greater than or equal to 11 g/cc.

10. A shaped charge, comprising:

a casing member;

an explosive component positioned within an interior volume of the casing member; and a multi-material liner coupled to the explosive component, wherein the multi-material liner comprises a first liner portion and a second liner portion, wherein:

the first liner portion is disposed between the explosive component and the second liner portion, wherein the first liner portion comprises a first apex and a first skirt section, wherein an outer surface of the first liner portion comprises a curved surface along the first apex, the first liner portion is formed of a first metallic material and a first non-metallic material, the first liner portion lacks a first binder to hold the first metallic material and the first non-metallic material together, the second liner portion is in contact with the outer surface of the first liner portion along the first apex of the first liner portion, wherein the second liner portion comprises a second apex and a second skirt section, and wherein the second liner portion comprises a flat planar surface along the second apex, the second liner portion is formed of a second metallic material and a second non-metallic material, and the second liner portion lacks a second binder to hold the second metallic material and the second non-metallic material together.

11. The shaped charge of claim 10, wherein the second liner portion extends along 50% or less of a total length of the first skirt section of the first liner portion.

12. The shaped charge of claim 10, wherein a thickness of the second liner portion varies at different axial positions.

13. The shaped charge of claim 10, wherein the first liner portion has a first green density, and wherein the second liner portion has a second green density that is different than the first green density.

14. The shaped charge of claim 10, wherein the second liner portion comprises a planar symmetry.

15. The shaped charge of claim 10, wherein the first liner portion, the second liner portion, or both, comprise machine metal parts, injection molded plastic parts, ceramic parts, or any combination thereof.

16. The shaped charge of claim 10, wherein a density of the second liner portion is greater than or equal to 11 g/cc.

17. A method, comprising:

forming a first shaped charge liner portion using a first metallic material and a first non-metallic material without a binder, wherein the first shaped charge liner portion comprises a first apex and a first skirt section, and wherein an outer surface of the first shaped charge liner portion comprises a curved surface along the first apex;

forming a second shaped charge liner portion using a second metallic material and a second non-metallic material without a binder, wherein the second shaped charge liner portion comprises a second apex and a second skirt section, and wherein the second shaped charge liner portion comprises a flat planar surface along the second apex; and coupling the second shaped charge liner portion to the outer surface of the first shaped charge liner portion.

18. The method of claim 17, comprising providing the second shaped charge liner portion within an explosive component of a shaped charge.

19. The method of claim 17, wherein the first shaped charge liner portion and the second shaped charge liner portion do not substantially overlap.

20. The method of claim 17, wherein the second shaped charge liner portion comprises machine metal parts, injection molded plastic parts, ceramic parts, or any combination thereof.

* * * * *